United States Patent [19]

Kähönen

[11] Patent Number: 4,957,029

[45] Date of Patent: Sep. 18, 1990

[54] ACTION FOR A WIND INSTRUMENT

[76] Inventor: Matti Kähönen, Porvoonkatu 37 A 4, 00520 Helsinki, Finland

[21] Appl. No.: 314,068

[22] PCT Filed: Jun. 8, 1988

[86] PCT No.: PCT/FI88/00089

§ 371 Date: Mar. 1, 1989

§ 102(e) Date: Mar. 1, 1989

[87] PCT Pub. No.: WO88/09987

PCT Pub. Date: Dec. 15, 1988

[30] Foreign Application Priority Data

Jun. 8, 1987 [FI] Finland ..... 872562

[51] Int. Cl.[5] ..... G10D 7/02

[52] U.S. Cl. ..... 84/384

[58] Field of Search ..... 84/380 R, 381, 382, 84/384, 385 R, 216

[56] References Cited

U.S. PATENT DOCUMENTS

| | | | |
|---|---|---|---|
| 1,119,954 | 12/1914 | Haynes | 84/380 |
| 1,705,634 | 3/1929 | Bettoney | 84/382 |
| 2,226,536 | 12/1940 | Selmer | 84/382 |
| 2,976,756 | 3/1961 | Schwarzbaur | 84/216 |

FOREIGN PATENT DOCUMENTS

| | | |
|---|---|---|
| 557928 | 8/1932 | Fed. Rep. of Germany . |
| 3438618 | 2/1986 | Fed. Rep. of Germany . |

*Primary Examiner*—Brian W. Brown

*Attorney, Agent, or Firm*—Toren, McGeady & Associates

[57] ABSTRACT

The invention concerns an action (1, 2) for a wind instrument, comprising keys (6) pivoted turnably relative to the body (3) of the instrument, holes (5) in the body being openable and closable with said keys according to the player's operation for producing notes of different pitch. A key action of this kind is found e.g. on the flute and on other woodwinds. As taught by the invention, the action comprises keys (6) which have been provided with magnets (12) so that the magnet returns the key that has turned into its initial position when the player ceases to press the key or the touch acting thereon. The keys (6) may be open keys which stay open by effect of mutually repulsing magnets (12) and close when pressed by the player against the repulsion of the magnets, or closed keys which are kept closed by mutually attracting magnets and open when pressed against the attraction of the magnets by the player, by touches connected with the keys.

7 Claims, 2 Drawing Sheets

ACTION FOR A WIND INSTRUMENT

Figure 1:
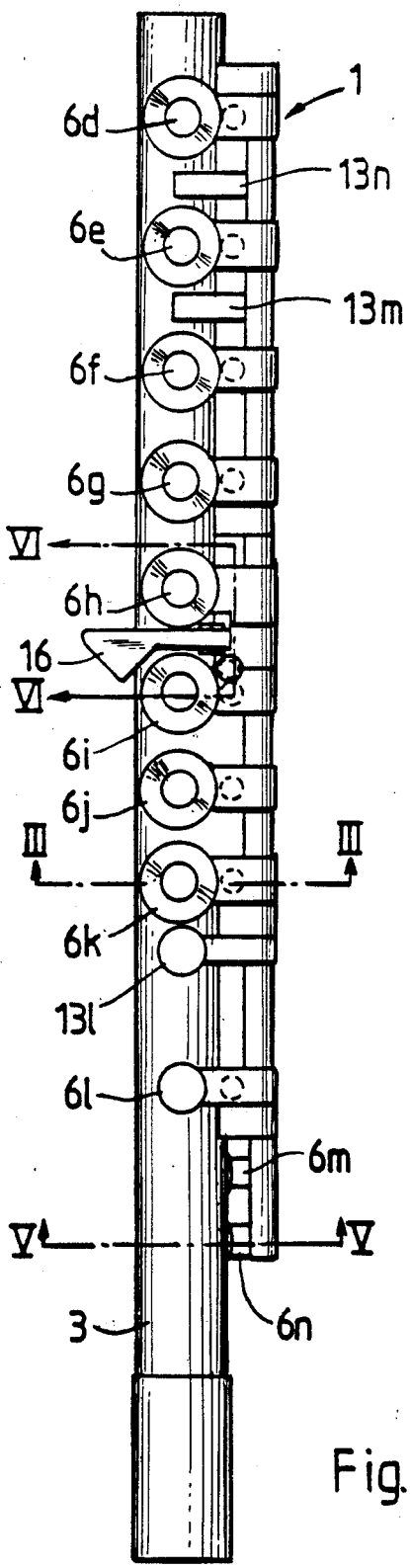

The present invention concerns a wind instrument action comprising keys turnably pivoted relative to the body of the music instrument and by which holes provided in said body can be opened and closed at the player's option for producing notes of various pitch.

The group of wind instruments fitted with keys include the flute, oboe, clarinet, bassoon and saxophone. These instruments have a tubular body provided with holes which used to be made of wood but for which nowadays, depending on the particular instrument, also other materials are used, particularly metal. The sound of the instrument is generated by the air column vibrating within the tubular body, its length, which varies in accordance with the selection of opened and closed holes, determining the pitch in each instance.

The return of the keys to their initial position after the player ceases to depress them has been accomplished with the aid of springs in existing wind instruments. These springs are encumbered by the drawback that they are subject to fatigue in use in the course of time so that their resetting force diminishes. As a consequence the playing properties of the instrument change, and the springs have to be replaced when their reset has become weak enough. New springs restore the original properties of the instrument, but these too require renewed coaching up on the player's part.

The object of the present invention is to constitute a wind instrument action provided with a novel key resetting mechanism in which the drawbacks initially mentioned are avoided. The invention is characterized in that the action comprises keys which have been fitted with magnets so that the magnet returns any flap that has turned to its original position when the player ceases to depress the key or the touch acting thereon.

Magnets present the essential advantage over the springs used heretofore that they are virtually fatigue-free, that is their resetting force does not deteriorate with time. This means that the need of renewal is avoided and that the playing characteristics of the instrument, i.e., the forces with which the player has to press the keys or their touches against the effect of said magnets, undergo no change. Furthermore, the use of magnets reduces the friction occurring in the action, and the non-linear attraction or repulsion between magnets gives the player a more precise feel than before of the operation of the action.

By using magnets instead of springs the further advantage is gained that the construction of the instrument's action is simplified and its assembly becomes easier. The manufacturing cost of the instrument will also be lower since magnets are substantially less expensive than springs.

According to the invention one may use for magnets either magnets which attract each other or magnets which repel each other. The magnets are so selected that they replace the springs heretofore employed in such actions, without changing the individual mode of operation of each instrument's action. Thus, the action may comprise magnets which have been disposed to keep the key open (so-called open key), in which case on depression of the key the key closes against the hole in the body and opens under effect of the magnet when the pressure ends. The action may similarly comprise magnets which keep the key closed against the hole in the body (so-called closed key), in which case the key opens on pressing the touch which acts on it, and closes under effect of magnets after the pressure has ceased.

The mechanism of the invention is advantageously a flute mechanism comprising open keys fitted with magnets, said keys producing (when closed) the notes C, C sharp, D sharp, E, F, F sharp, G sharp A, B flat and $C^2$, and closed keys fitted with magnets, producing the notes D, $D^2$ and $D^2$ sharp. The last-mentioned two closed keys are then so-called trill keys.

In the action of the invention one may furthermore advantageously implement the arrangement in which with an open key held open by a magnet is coupled, over a separate magnet, another key in such manner that said keys can be moved together and where the last-mentioned key is furthermore provided with a touch by means of which the keys can be uncoupled. In the flute the so-called Dorus's arrangement is implemented so that said open key produces the note G sharp and the other key coupled with it by a magnet, the note G. This coupling is acoustically advantageous: it is possible with its aid to eliminate in the flute action one hole and its key: its implementation with the aid of springs has, however, been awkward heretofore. In contrast, no problems are encountered in its implementation when magnets are employed, as taught by the invention.

Figure 2:
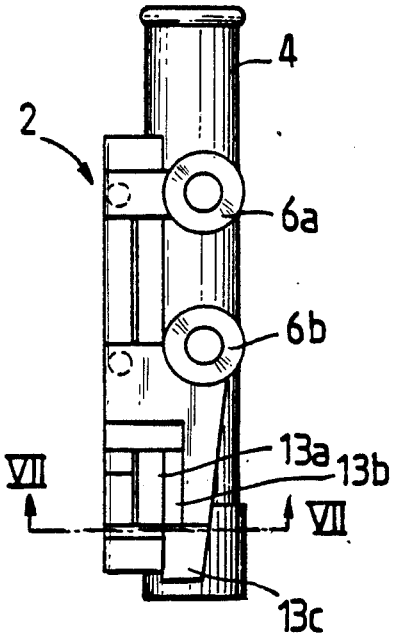
Figure 3:
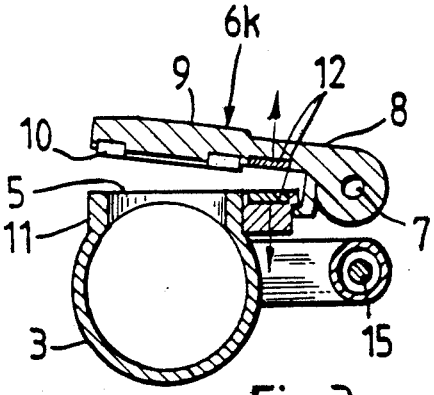
Figure 4:
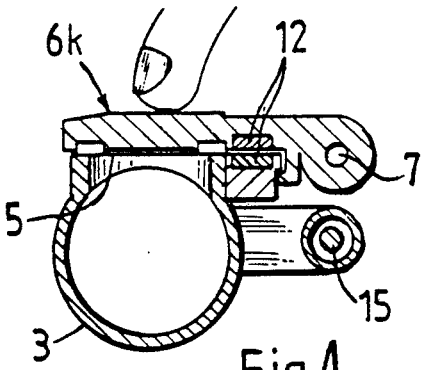
Figure 5:
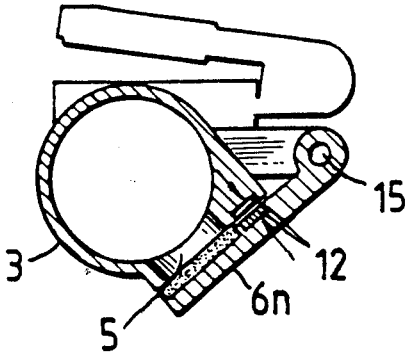
Figure 6:
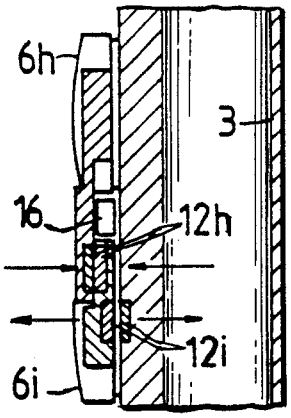
Figure 7:
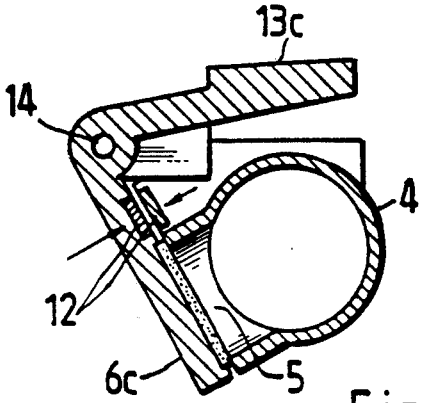

The invention is described in closer detail in the following with the aid of an example, referring to the attached drawings, in which for exemplary instrument has been chosen a crossflute consisting of three consecutive sections that can be fitted together, and where:

FIG. 1 presents the middle section of the flute, comprising part of the action of the invention, affixed to the tubular body part, FIG. 2 presents the foot part of the flute, which comprises the rest of the action of the invention, affixed to the tubular body part, FIG. 3 presents the body tube at a hole and the key therewith connected, in section III—III of FIG. 1, with the key open under effect of magnets (open key), FIG. 4 is equivalent to FIG. 3 but shows the key when it has been closed by the player, FIG. 5 presents the body tube with hole and key in section V—V of FIG. 1 in a case in which the magnets keep the key closed (closed key), FIG. 6 presents the Dorus arrangement which is part of the key mechanism, in section VI—VI of FIG, 1, and FIG. 7 presents the body tube with a hole closed by the key (closed key), in section VII—VII of FIG. 2.

A crossflute typically comprises an elongated, tubular body which consists of three tubular parts joinable consecutively together. The invention concerns the action 1,2 of the flute which is attached to the central and rear parts 3,4 of the body, and for this reason the front part of the body, being inconsequential in view of the invention, has been omitted in the drawing.

In the body 3,4 of the flute holes 5 have been made for producing notes of various pitches (FIGS. 3, 4, 5 and 7), these holes being openable and closable with the aid of keys 6 installed adjacent to the holes. The foot part of the body comprises the keys *6a,6b* (FIG. 2) and *6c* (FIG. 7), which produce the notes C, C sharp and D sharp, in this order. The central part of the body, 3, comprises the keys *6d–6l* seen in FIG. 1, producing the notes D sharp, E, F, F sharp, G, G sharp, A, B flat and $C^2$. Moreover, the central part 3 of the body comprises immediately before the key *6l* a key producing the note B, this key being hidden under the body tube in FIG. 1, and after the key 61 the so-called trill keys *6m,6n* producing the notes $D^2$ and $D^2$ sharp, this also lying hidden under the body tube in the figure, but one of them being seen in section in FIG. 5. It should be noted that the notes mentioned are those which are generated when the respective key is closed.

The majority of the keys belonging to the action 1,2 are so-called open keys which close against the hole in the body when pressed and which open automatically when the pressure ceases. The construction of a key of this kind is more closely seen in FIGS. 3 and 4, which present the body tube 3 with its holes and with its keys belonging to the action, sectioned at the location of the flap *6k* producing the note B flat. The key *6k* is turnably pivoted on the axle 7 and comprises an arm B and on the end thereof, opposite to the hole 5 in the body 3, a flap part 9. The flap 9 of the key is provided with an annular seal 10 which is pressed against the collar 11 encircling the hole 5. On the side of the hole 5 on the body and on the key arm 8, magnets 12 repulsing each other have been mounted, which keep the key *6k* open as shown in FIG. 3 when the key is not pressed. In FIG. 4 the same key has been depicted, pressed closed against the repulsive force of the magnets 12. Immediately when the player ceases to press the key *6c*, the magnets 12 open it, returning it to the position of FIG. 3.

Other keys, in addition to the key *6k* producing the note B flat, implemented as shown in FIGS. 3 and 4 are the keys *6d, 6e, 6f, 6g, 6i* and *6j*, which produce, respectively, the notes D sharp, E, F sharp, G sharp and A. Furthermore, substantially according to the same principle operate the keys *6a* and *6b* in the foot part of the flute, these keys producing the notes C and C sharp, and the key *6l* in the central, part of the flute, which produces the note $C^2$. There is, however, one difference: the keys mentioned last, *6a, 6b* and *6l* are not pressed directly but over separate touches *13a, 13b* and *13l* connected with the keys by shafts. It may further be mentioned that the key producing the note B, which is not visible in the drawings, also operates according to the principle of FIGS. 3 and 4.

On the side of the open keys, the flute action comprises closed keys, which are kept closed against the holes in the body by mutually attracting magnets and which come open when separate touches, connected to the keys, are pressed, overcoming the attraction force of the magnets. In FIG. 7 can be seen the key *6c*, operating in this manner, which is located in the foot part of the flute and produces the note D. The key *6c* is pivoted over an axle 14 to the touch *13c* and opens when this is pressed. As soon as the pressure ceases, the magnets 12 immediately return the key to the position of FIG. 7, in which the key closes the hole 5 in the body 4. In fully equivalent manner operate the trill keys *6m* and *6n* located in the central part 3 of the flute and producing the notes $D^2$ and $D^2$ sharp, one of which keys is seen in section in FIG. 5. The touches *13m,13n* for the trill keys *6m,6n* have been placed on the end of the central part 3 of the flute opposite to the keys and they are connected with said keys by the trill shaft 15.

In FIG. 6 is depicted in section the so-called Dorus's arrangement in the central section of the flute, comprising the keys *6h* and *6i*, which produce the notes G and G sharp. The key *6i* is a open key like those described above, and it is normally kept open by mutually repulsing magnets *12i* and closes when pressed. With this key *6i* has been coupled, by mediation of separate mutually attracting magnets *12h*, the adjacent key *6h* in such manner that the two keys move in concert, that is, pressing the key *6i* also causes the key *6h* to close. However, the arrangement also includes a touch 16 which, when pressed, lifts the key *6h* off the key *6i*, against the attraction of the magnets *12h*. The key *6i* may then be closed independent of the key *6i*.

It is obvious to a person skilled in the art that different embodiments of the invention are not confined to the example presented in the foregoing and that they may vary within the scope of the claims following below, Thus, the invention is not confined to a flute: other woodwinds may equally be contemplated, in other words, oboe, clarinet and bassoon, or saxophone.

I claim:

1. An action for a wind instrument having a body (3, 4) with holes (5) therein, comprising:

keys (6) turnable relative to the body (3, 4) so as to selectively open and close the holes (5) to produce notes of different pitch; and two magnets (12) associated with each of said keys (6) so as to return each key (6) to an initial position after actuation of the key (6) ceases, a first of said two magnets being disposed on each of said keys (6) and a second of said two magnets being disposed on said body (3, 4).

2. An action according to claim 1, wherein said first and second magnets are mutually repulsing so as to keep the associated key (6) in an open position so that when the key (6) is pressed to close an associated hole (5) in the body (3, 4), the hole (5) is opened by action of said first and second magnets (12) when the pressing of the key (6) ceases.

3. An action according to claim 2, wherein the instrument is a flute, the keys (6) being open flaps (*6a, 6b, 6d, 6e, 6f, 6g, 6i, 6j, 6k, 6l*), and the notes produced by the open flaps being C, C sharp, D sharp, E, F, F sharp, G sharp, A, B flat, B and $C^2$.

4. An action according to claim 1, wherein said first and second magnets (12) in at least one of the keys (6) are mutually attracting so as to hold the at least one key (6) closed against a corresponding hole (5) in the body (3, 4), and further comprising a touch (13) actable on the at least one closed key (6) so as to open the hole (5) when the touch (13) is pressed, said first and second magnets (12) closing the open hole when pressure on the touch (13) ceases.

5. An action according to claim 4, wherein the instrument is a flute, the keys (6) including a closed key (*6c*) and trill keys (*6m, 6n*), the note produced by the closed key (*6c*) being D and the notes produced by the trill keys (*6m, 6n*) being $D^2$ and $D^2$ sharp.

6. An action according to claim 1, wherein the keys (6) include an open key (*6i*) held open by its associated those magnets being mutually repulsing first and second magnets (*12i*) and a second key (*6h*) associated with third and fourth magnets, those magnets being mutually attracting, and (*12h*) arranged so as to couple the open key (*6i*) and the second key (*6h*) so that said open key (*6i*) and said second key (*6h*) can be moved in concert, the second key (*6h*) having a touch (16) arranged so as to uncouple said open key (*6i*) and said second key (*6h*).

7. An action according to claim 6, wherein the instrument is a flute, the note produced by said open key (*6i*) being G sharp and the note produced by said second key (*6h*) coupled with the open key (*6i*) being G.

* * * * *